United States Patent [19]

Holland

[11] 4,106,408

[45] Aug. 15, 1978

[54] DUPLICATOR CYLINDER CONSTRUCTION

[75] Inventor: Norman Holland, Liege, Belgium

[73] Assignee: Addressograph Multigraph Corporation, Cleveland, Ohio

[21] Appl. No.: 770,330

[22] Filed: Feb. 22, 1977

Related U.S. Application Data

[63] Continuation of Ser. No. 604,503, Aug. 13, 1975, abandoned, which is a continuation of Ser. No. 420,218, Nov. 29, 1973, abandoned.

[51] Int. Cl.[2] ..... B41C 1/18; B41C 3/02; B22D 19/02

[52] U.S. Cl. ..... 101/401.1; 29/132; 164/2; 164/95

[58] Field of Search ..... 29/132; 101/401.1; 164/2, 95

[56] References Cited

U.S. PATENT DOCUMENTS

| | | | |
|---|---|---|---|
| 949,837 | 2/1910 | Page | 164/95 |
| 1,115,870 | 11/1914 | Sheaffer | 164/95 |
| 1,514,129 | 11/1924 | Clark | 164/95 |
| 1,584,368 | 5/1926 | Geiger | 101/401.1 |
| 1,943,720 | 1/1934 | Campbell | 164/95 |
| 1,995,973 | 3/1935 | Ericksson | 101/401.1 |
| 2,034,599 | 3/1936 | Van Marle | 29/132 |
| 2,285,116 | 6/1942 | Grupe | 101/378 |
| 3,416,435 | 12/1968 | Dahl | 29/132 |
| 3,450,189 | 6/1969 | McDonald | 164/95 |
| 3,682,094 | 8/1972 | Greis | 29/132 |
| 3,754,593 | 8/1973 | Stone | 164/95 |
| 3,807,485 | 4/1974 | Paton | 164/95 |

*Primary Examiner*—Clyde I. Coughenour
*Attorney, Agent, or Firm*—S. L. Goldstein

[57] ABSTRACT

Cylinders for lithographic printing machines having hard, non-porous surfaces are made without plating by forming a thin stainless steel sheet into a cylindrical shape and disposing it against the wall of a cylindrical mould. Cast iron is poured into the mould at temperatures substantially in excess of normal casting temperatures to bond with the stainless steel sheet. The surface is then ground and polished. Preferably the stainless steel is initially provided with a thin plating of copper on its inner surface to enhance the bond.

3 Claims, 2 Drawing Figures

DUPLICATOR CYLINDER CONSTRUCTION

This is a continuation, of application Ser. No. 604,503, filed Aug. 13, 1975 now abandoned, which is a continuation of application Ser. No. 420,218, filed Nov. 29, 1973, now abandoned.

BACKGROUND OF THE INVENTION

Duplicating equipment for lithographic reproduction requires a series of cylinders for handling the various elements involved in the lithographic duplicating process. It is conventional for lithographic duplication to use a master which is mounted on a master cylinder. An oleophilic ink and moisture are applied to the master while it is clamped on the master cylinder, to put it into condition for printing. Any areas of the master cylinder which are not covered by the master are exposed with the master to the application of ink and moisture. These exposed areas must not attract or hold ink. If any exposed areas of the cylinder accept ink from the ink form roller, this ink will then transfer to the blanket which is retained on the blanket cylinder and thence to any impression paper which contacts the blanket. Only the image portions on the master must retain ink; every other portion of the master, as well as the exposed areas of the master cylinder, must be free of ink.

Heretofore, these lithographic duplicating cylinders were commonly prepared by casting high-strength iron, such as Mehanite; thereafter the cylinder was ground and given a hard chromium surface using conventional electro-plating techniques. The electro-plated chromium surface was then treated to secure and retain its water receptivity by preventing the formation of any oxides on the surface. Aqueous acidified ammonium chloride plus excess chalk was commonly used for this treatment.

The electro-plating technique tends to highlight any irregularities such as pits, holes, or cracks in the cast surface. Accordingly, the cast iron cylinders that would be acceptable for chrome plating required highly uniform surfaces; rejects were numerous.

SUMMARY OF THE INVENTION

This invention provides a cylinder for lithographic duplicating whose surface is made of stainless steel. In this way it is possible to produce a simple and economical structure with fewer rejects than normal with the previously known chromium plated cylinders. The invention is also concerned with methods of making cylinders for lithographic duplicating.

It will be appreciated that the primary function of the master cylinder is to serve as a support for the lithographic master. The use of stainless steel as the surface for such a cylinder, in accordance with this invention permits the use of cast iron support material whose surface need only be in a reasonable condition of uniformity to accept the stainless steel layer. The present invention can make use of a cast iron cylinder the surface of which would have been unacceptable for the electro-plating process.

DESCRIPTION OF THE PREFERRED EMBODIMENTS

Figure 1:
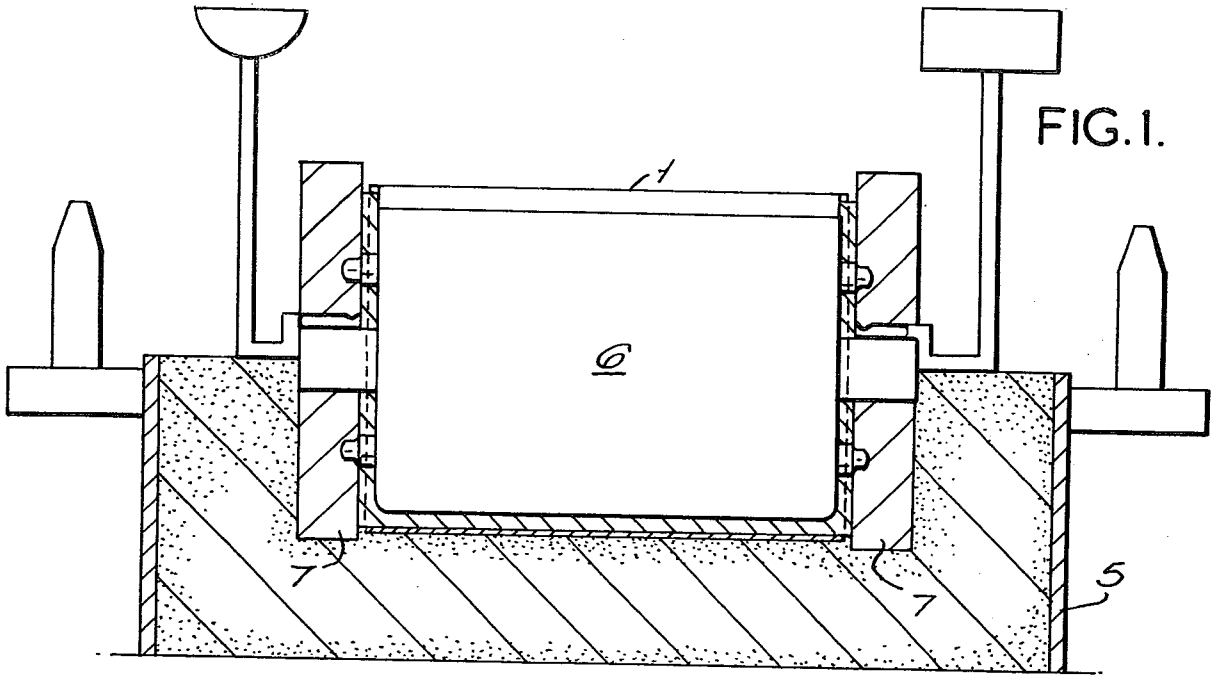
FIG. 1 is a longitudinal section illustrating the formation by casting of the preferred form of master cylinder according to the invention.
Figure 2:
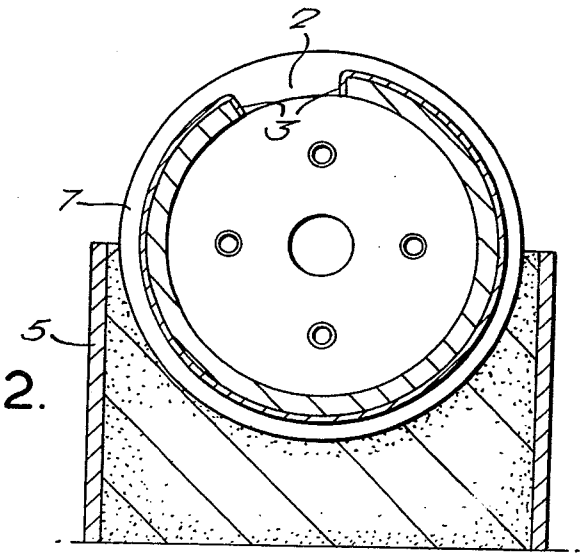
FIG. 2 is a transverse section of the apparatus shown in FIG. 1.

The invention in a preferred form provides a cylinder having a cast iron body and a stainless steel outer layer which is bonded to said cylinder. The invention also provides for a method of making the cylinder in which a stainless steel sheet is formed into a cylindrical shape which then forms the liner of a mould into which is moulded cast iron at a temperature higher than the normal pouring temperature, thereby bonding the cast iron to the stainless steel liner.

When the stainless steel layer is applied by incorporating it into the casting, in accordance with the present invention, then the range of thickness of the sheet may be from 0.040 inches to 0.20 inches, the preferred range being 0.090 to 0.150 inches in thickness.

The types of stainless steel materials that can be used fall into three general classifications, namely: ferritic, austenitic and martensitic; the preferred stainless steel is austenitic. Typical of these grades of stainless steel, using the designation of the American Iron and Steel Institute, the grade specification numbers are as follows: ferritic: Nos. 403, 405 and 410; austenitic: Nos. 303, 316, and 318; martensitic: Nos. 440A, 440B, and 440F. It will be appreciated that the listing of these grades of stainless steel is intended to suggest representative grades and not intended to restrict the invention to any specific formulation.

EXAMPLE 1

The master cylinder prepared according to this example involves the use of a sheet of stainless steel which is 0.104 inches in thickness which is of the austenitic grade No. 303 (American Iron and Steel Institute designation). Referring to the drawings, the stainless steel sheet is formed into the shape of the cylinder with a longitudinal gap 2 corresponding to the size of the slot into which will be received the master clamping mechanism to retain the master on the cylinder. The ends 3 of the sheet defining the gap 2 are turned inwardly toward the axis of rotation of the cylinder. To the inner surface of the stainless steel sheet is imparted by electro-plating a coating of copper plate, taking care to avoid plating the outside. In order to apply the copper plating only to the inside, an internal anode may be used; alternatively, the outer surface can be protected with a lacquer coating to prevent any deposition of copper thereon. The purpose and function of the copper plating is to provide better bonding of the stainless steel sheet to the cast iron support.

The sheet is placed in a conventional core box 5. The core box is assembled in accordance with standard molding procedures which involve the insertion of the proper cores a body core 6 and end cores 7. Into the mold is poured molten cast iron (preferably grade 14 grey iron). The pouring temperature of the iron is higher than what would normally be utilized in such casting techniques. For example, if the normal pouring temperature is 1300° C, the temperature preferred according to the invention will be at least 150° C higher, or 1,450° C. The pouring is, of course, done under the usual ambient conditions of the normal foundry, and without any significant special heating of the mold or the stainless steel sheet. For the purposes of this application, such conditions will be referred to as normal ambient foundry temperature conditions.

After being allowed to cool, the cylinder is then removed from its mold, set up on bearings, and the stainless steel surface is ground and polished. It will be appreciated that at this point in the operation no electroplating on the outer surface of the cylinder is required, so that the disadvantage associated with the plating step of the conventional cylinder described hereinabove are avoided.

The turned-in ends 3 of the stainless steel 1 sheet become embedded in the cast iron. It will be appreciated that this technique of utilizing the stainless steel sheet as a liner in the molding operation conveniently permits the formation of the longitudinal gap 2 in the cylinder in which is to be placed the clamping mechanism.

It is to maintain a uniform diameter and parallelism, which must meet the tolerance of 0.0005 inches and 0.001 inches per foot, respectively.

The stainless steel surface master cylinder, after the grinding and polishing is completed, requires a final treatment in order to increase the degree of wettability. This treatment can take two forms, chemical or elctrochemical. Normally in production an electro-chemical treatment is used which requires the application of a fairly weak current in a bath of aqueous acidified ammonium chloride with excess chalk. As a result the surface of the stainless steel becomes highly wettable.

The master cylinder produced in accordance with this example performs in a manner similar to the prior art chrome plated master cylinders. Overall, the performance of such stainless steel cylinders are known to give fully acceptable performance when given the proper care and frequent enough treatment with the solutions described herein in order to maintain the high degree of wettability.

Conventional grinding and polishing operations usually involve the use of polishing and/or grinding solutions. In order to protect the surface from becoming ink receptive, it is important that such grinding and polishing solutions not contain any oleophilic materials and, preferably should be a water-glycerine mixture.

EXAMPLE 2

In this example, the master cylinder, having thereon a stainless steel surface, was prepared following the procedures and techniques described in Example 1, with the exception that in place of austenitic stainless steel 303, stainless steel No. 318 was employed.

The master cylinder produced using this type of stainless steel gave results which were the same as that obtained in Example 1.

EXAMPLE 3

The master cylinder prepared in this example followed the procedures and techniques set forth in Example 1 with the exception that a martensitic stainless steel No. 440A was used in place of the austenitic stainless steel 303 of Example 1.

EXAMPLE 4

The master cylinder prepared in this example followed the procedures and techniques set forth in Example 1, with the exception that a ferritic grade stainless steel No. 403 was used in place of the austenitic stainless steel 303 of Example 1.

I claim:

1. For a lithographic duplicator, a cylinder comprising a support body and a preformed outer layer of stainless steel sheet, the cylinder being so configured as to present a longitudinal surface gap and the stainless steel sheet having its ends bent so as to extend into and define the gap, wherein the support body is of cast iron which has been formed under normal ambient foundry temperature conditions by casting against the interior of the otherwise unheated preformed outer layer at a pouring temperature at least 150° C above its normal pouring temperature, and thereby bonded to the interior surface of the outer layer throughout its area including the bent ends.

2. A cylinder as claimed in claim 1 in which the thickness of the stainless steel sheet is between 0.040 inches and 0.20 inches.

3. A cylinder as claimed in claim 1 in which the bonded interface includes a tenuous layer of copper preplated on the inside surface of the stainless steel layer.

* * * * *